United States Patent [19]

Browning

[11] Patent Number: 4,890,375

[45] Date of Patent: Jan. 2, 1990

[54] REPAIR OF STEEL-MAKING VESSELS

[75] Inventor: Richard J. Browning, Porthcawl, United Kingdom

[73] Assignee: Goricon Metallurgical Services Limited, Bridgend, United Kingdom

[21] Appl. No.: 179,071

[22] Filed: Apr. 8, 1988

[30] Foreign Application Priority Data

Apr. 8, 1987 [GB] United Kingdom ..... 8708414

[51] Int. Cl.[4] ..... B22D 19/10

[52] U.S. Cl. ..... 29/402.16; 29/402.18; 29/527.1; 29/530; 206/582

[58] Field of Search ..... 220/465; 29/402.16, 29/402.18, 527.1, 530; 206/582

[56] References Cited

U.S. PATENT DOCUMENTS

| | | | |
|---|---|---|---|
| 816,558 | 4/1906 | Coffin | 220/465 |
| 2,131,792 | 10/1938 | Coakley | 220/465 X |
| 3,557,435 | 1/1971 | Powell et al. | 29/402.18 X |
| 3,944,193 | 3/1976 | Imai et al. | 164/39 X |
| 4,130,924 | 12/1978 | Madill | 29/402.03 |
| 4,619,374 | 10/1986 | Yavorsky | 220/465 X |

FOREIGN PATENT DOCUMENTS

| | | | |
|---|---|---|---|
| 210357 | 2/1987 | European Pat. Off. | 29/402.18 |

*Primary Examiner*—Mark Rosenbaum
*Assistant Examiner*—Frances Chin
*Attorney, Agent, or Firm*—Young & Thompson

[57] ABSTRACT

A plug 4 fitted in the side wall of a steel-making vessel is sealed in place by a crushed refractory material 8. This tends to burn off after a number of pourings of molten steel to create an enlarged approach well. This well can be repaired by inserting a steel pipe 10 having a tapered portion 12 leading to a narrow entry portion 11 so as to seal off the tap hole 5 in the plug 4. The well can then be filled with a refractory material 14 which sinters or fuses with heat to effect the repair. The steel pipe 10 will burn off during a subsequent heating and pouring of molten steel.

7 Claims, 2 Drawing Sheets

REPAIR OF STEEL-MAKING VESSELS

Molten steel is poured through a tap hole in the side wall of a steel-making vessel by tipping the vessel about a pivotal support. A conventional method of providing a tap hole in the vessel side wall is to insert a plug of a fired refractory material into a passage-way drilled through the side wall. The plug incorporates the tap hole but after a number of pourings the molten steel erodes the plug to such an extent that it has to be replaced. A further problem is that the region leading from the end of the plug to the inner wall of the vessel is filled with a refractory material which seals off the space between the plug and the wall of the passage-way drilled through the side wall of the vessel, but this material is essentially of inferior quality and tends to degrade more rapidly than the material of the plug. If this inferior material were to burn away completely the molten steel could seep around the outside of the plug and destroy the fixing of the plug. If the plug were to fall out the resulting rapid outflow of molten steel could be catastrophic. Consequently for safety reasons it may be necessary to replace the plug before the plug itself has deteriorated beyond reasonable use. It takes some time to replace the plug, which therefore puts the vessel out of commission. It is an object of this invention to improve the usable life of refractory tap hole plugs of steel-making vessels.

Accordingly this invention provides a method of preparing an enlarged approach to a tap hole defined by a refractory insert embedded in the side wall of a steel-making vessel, wherein an iron pipe having a tapered entry end is seated within the tap hole, the exterior of the larger diameter end of the pipe being only a little larger than the existing tap hole diameter in the refractory insert and filling the enlarged well in the side wall of the vessel around the larger diameter end of the pipe with a settable refractory material and allowing the material to set.

This repairing method can be carried out much more rapidly than full replacement of this refractory insert plug and of course it means that the plug can be left in place much longer, thus saving on the cost of such plugs over a period of time. Once the repair has been carried out the tap hole construction will be returned substantially to its original condition.

It is preferred that the entry end of the pipe should terminate in a length of pipe of constant diameter, corresponding to the small diameter of the taper, serves to provide a lead in to the tap hole in the refractory insert. The larger diameter end of the pipe is advantageously provided with an insert boom enabling the pipe to be manipulated into position. The pipe is preferably formed from mild steel, which will burn out during the first pouring of molten steel through the tap hole.

The settable refractory material may comprise a crushed refractory material in a settable binder.

The invention may be performed in various ways and a preferred embodiment thereof will now be described with reference to the accompanying drawings, in which.

Figure 1:
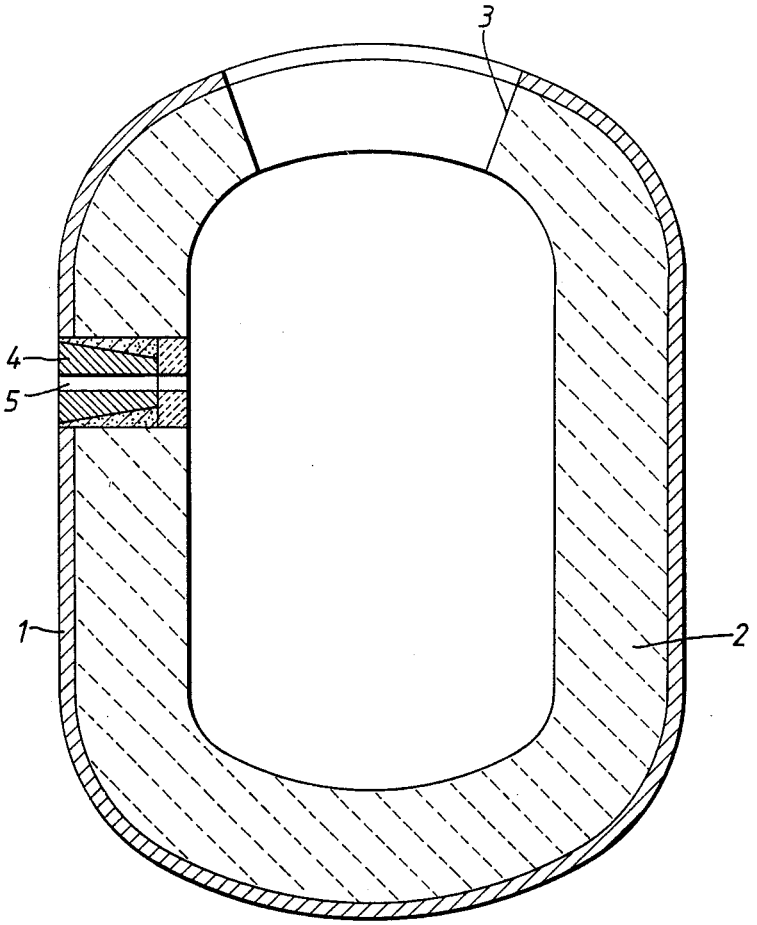
FIG. 1 is a cross-section through a steel-making vessel incorporating a plug defining a tap hole.

The steel-making vessel shown in FIG. 1 has an outer steel shell 1 lined laternally with a thick wall 2 of refractory bricks. An opening 3 at the top provides for the insert of steel-making materials. A plug 4 is fitted into the side wall of the vessel and defines a tap hole 5.

Figure 2:
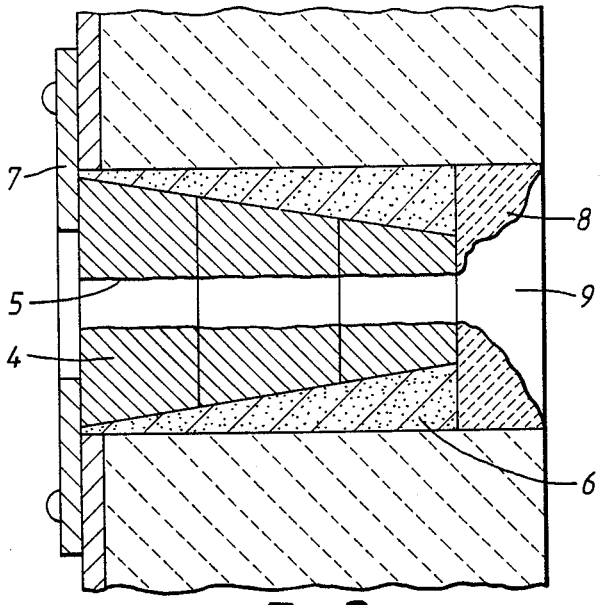
FIG. 2 is a section through part of the side wall of the vessel showing the plug after some use.
Figure 3:
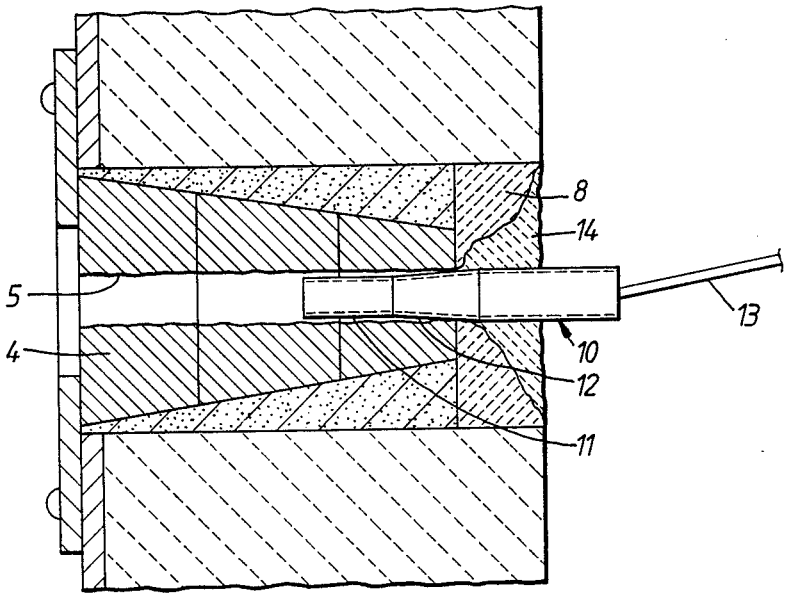
FIG. 3 illustrates the method of this invention for repairing the tap hole.

As shown in FIG. 2 the plug 4 is of tapered form constructed from a number of rings and held in place by a suitable cement 6 and by an outer metal collar 7. At the inner end the region between the end of the plug 4 and the inner wall of the vessel is filled with a set crushed refractory material 8. As shown this material tends to burn off after a number of pourings of molten steel to create an enlarged approach well 9. This well can be repaired by inserting a pipe 10, as shwon in FIG. 3, so that the narrow entry end portion 11 fits into the tap hole 5 in a plug 4 until the tapered portion 12 seats within the tap hole. The pipe 10 is introduced in a boom 13. When the pipe is in place the wall 9 is filled with a crushed refractory material in a settable binder which is allowed to set to form a plug 14. When steel is poured from the vessel the pipe 10 (formed from mild steel) will burn out to leave a tap hole of fairly constant diameter through the plugs 14 and 4. If necessary a further well formed at the entry to the tap hole could be filled in a similar manner.

As an alternative to fitting the well 9 with a crushed refractory material, a collar of suitable shape may be formed around the top part of the pipe 10 to enclose a refractory material in free-flowing form. The collar will be made from a material that will be destroyed by heat (at a lower temperature than the melting point of the steel pipe 10 itself) thus allowing the refractory material to escape and flow into the worn area forming the well 9, where it will sinter or fuse to effect the repair.

I claim:

1. A method of repairing an enlarged approach region of a tap hole in a side wall of a steel-making vessel, the tap hole having a predetermined normal diameter, by using an iron pipe having a larger diameter at one end, and having a tapered entry end, such that the larger diameter end of the pipe is only a little larger than the predetermined normal tap hole diameter, the method comprising the steps of seating the tapered entry end of the pipe within the tap hole, filling the enlarged approach region in the side wall of the vessel around the larger diameter end of the pipe with a settable refractory material, and allowing that material to set.

2. A method according to claim 1, wherein the tapered entry end has a taper and a large diameter and a small diameter and the entry end of the pipe terminates in a portion of constant diameter, which diameter corresponds to the small diameter of the taper.

3. A method according to claim 1, wherein the pipe is provided at the larger diameter end with an insert boom enabling the pipe to be manipulated into position.

4. a method according to claim 1, in which said tap hole is defined by an existing refractory insert embedded in said said wall.

5. A method according to claim 1, wherein the pipe is formed from mild steel.

6. A method according to claim 1, wherein the settable refractory material comprises a crushed refractory material in a settable binder.

7. A method according to claim 1, wherein the settable refractory material is held in a free-flowing form in a collar around the larger diameter end of the pipe, the collar being destroyed by heat to enable the refractory material to escape and flow into the enlarged approach region to sinter or fuse.

* * * * *